United States Patent [19]

Paules

[11] 3,959,951

[45] June 1, 1976

[54] FOOD PACKAGING MACHINE

[75] Inventor: Eugene H. Paules, Red Lion, Pa.

[73] Assignee: ExCel Engineering, Inc., Red Lion, Pa.

[22] Filed: Aug. 22, 1974

[21] Appl. No.: 499,443

Related U.S. Application Data

[62] Division of Ser. No. 390,370, Aug. 22, 1973, Pat. No. 3,849,969.

[52] U.S. Cl. ..... 53/162; 214/6 D; 214/6 H

[51] Int. Cl.[2] ..... B65G 57/11

[58] Field of Search ..... 214/6 H, 6 F, 6 D; 271/180, 181; 53/162, 163, 245; 100/215, 216

[56] References Cited

UNITED STATES PATENTS

| | | | |
|---|---|---|---|
| 2,024,503 | 12/1935 | Bickford | 53/163 |
| 3,014,601 | 12/1961 | Swanson | 214/6 H X |
| 3,318,068 | 5/1967 | Voullaire | 53/163 X |
| 3,456,423 | 7/1969 | Helms | 214/6.5 X |
| 3,585,777 | 6/1971 | Pesche | 53/162 X |
| 3,596,778 | 8/1971 | Lamonica et al. | 214/6 H |
| 3,655,186 | 4/1972 | Bayha | 214/6 H X |
| 3,804,266 | 4/1974 | Forthmann | 214/6 H X |

FOREIGN PATENTS OR APPLICATIONS

| | | | |
|---|---|---|---|
| 397,518 | 2/1966 | Switzerland | 53/162 |

*Primary Examiner*—L. J. Paperner
*Attorney, Agent, or Firm*—Paul & Paul

[57] ABSTRACT

Frozen patties are delivered for wrapping, one at a time at predetermined intervals, by means of a cleated conveyor belt which is fed by means of a trough receptical. A rotating wheel prevents more than one from being delivered at a time. The patties are coupled between a pair of rotating belts, the upper one of which is pivotally mounted relative to the other. As a patty pivots the upper belt, a paper feed and cutting mechanism is energized, and a paper segment is inserted in the path of the patty. Thus, the patty moves past the paper, causing it to adhere on the top and bottom surfaces of the patty. The wrapped patties are then passed through a second belt arrangement identical to the first, and thence to a packing assembly which stacks the wrapped patties in a plunger and cylinder arrangement in response to the pivotal displacement of the upper belt of the second belt assembly.

7 Claims, 13 Drawing Figures

Fig. 6
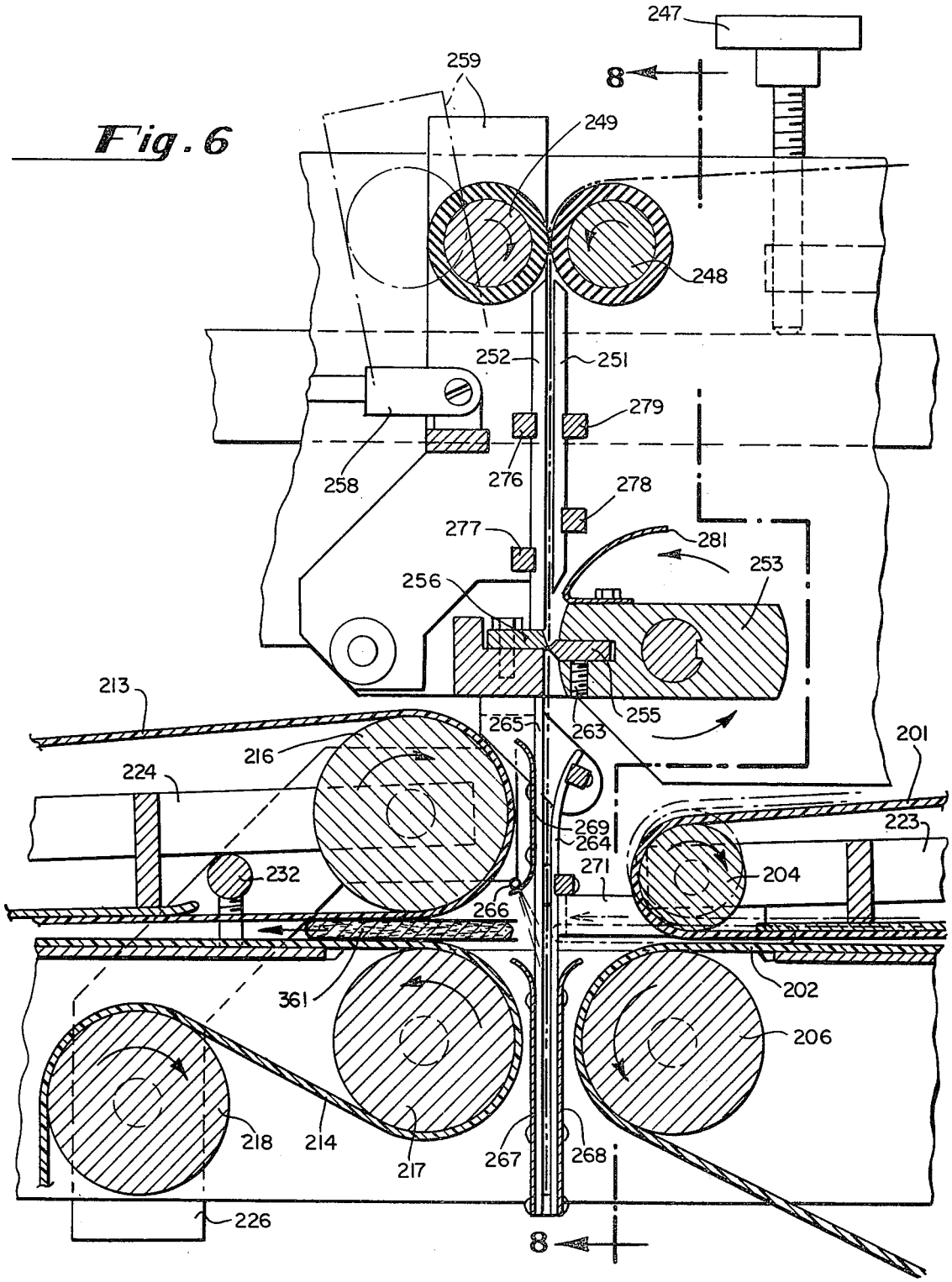
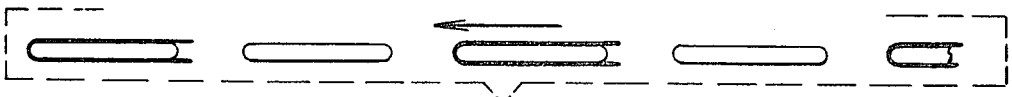
Fig. 7

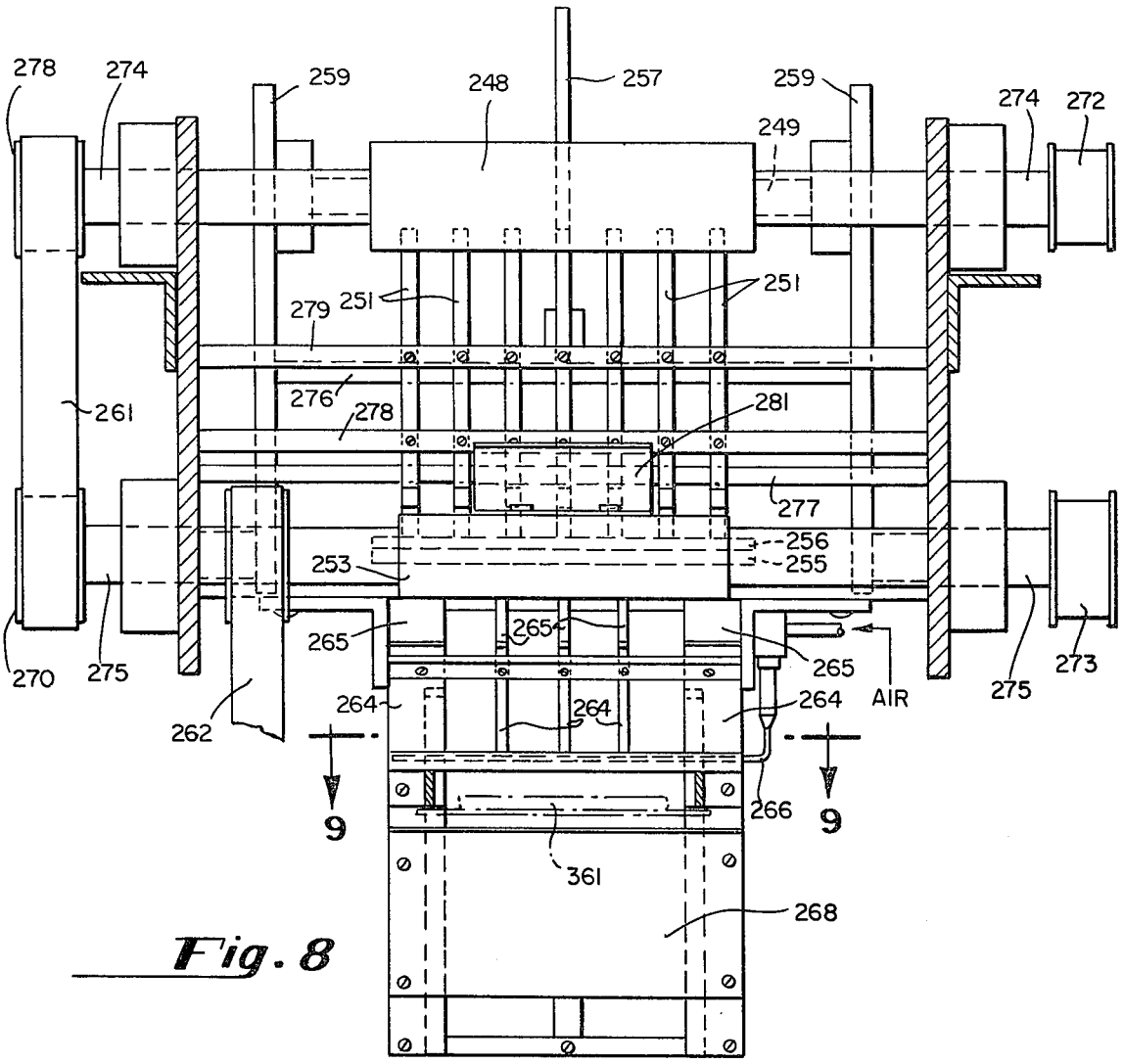
Fig. 8
Fig. 9
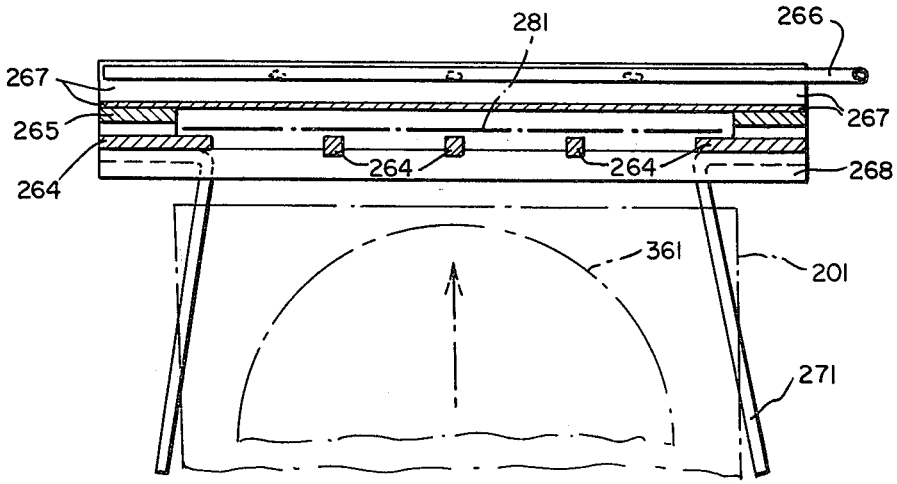

FOOD PACKAGING MACHINE

This is a division of application Ser. No. 390,370 filed Aug. 22, 1973 now U.S. Pat. No. 3,849,969.

BACKGROUND OF THE INVENTION

This invention relates to food packaging apparatus. More particularly, it relates to apparatus for applying wrapping paper to frozen patties or the like.

The overwhelming popularity of fast food establishments such as hamburger chain outlets has established a substantial continuing requirement for very large amounts of food supplies. These supply problems have largely been met by means of pre-prepared and prepackaged frozen food items. Accordingly, a high premium is being placed on economical and effective packaging and delivery of these items.

Food packaging machines for processing large numbers of frozen patties or the like must operate efficiently, at a rather high rate, and as cheaply as possible. Moreover, due to the sanitation requirements of the food packaging industry, the machines must be capable of rapid dismantling and reassembly, for purposes of cleaning.

It is accordingly, a primary object of the present invention to provide functionally efficient apparatus for packaging of frozen items such as hamburger patties.

It is further object of the present invention to provide such apparatus which may be rapidly and efficiently dismantled and for purposes of cleaning, and thence for reassembly.

SUMMARY OF THE INVENTION

The present invention is a machine for wrapping and packaging food items such as hamburger patties. Two separate wrapping processes are accomplished, a first one of which involves covering the top and bottom portions of the patties with separator type wrapping sheets, and a second one of which involves stacking the separator-wrapped patties in a container such as a sealable plastic wrapper. In accordance with the objects outlined above, an input segment performs the separation of the patties and the production of them one at a time, at predetermined intervals, for wrapping and packaging. A middle stage which involves self actuated control in response to the entry of patties therein, triggers the production of a segment of paper and the insertion thereof directly on the path of the oncoming patties. The patties are forced into and past the paper, causing the separator wrapper to adhere on the top and bottom of the patty. A third, and output stage, which involves the stacking and final packaging, operates in response to approach of the patties to be processed.

In an illustrative embodiment, a cleated conveyor belt is passed through a trough receptacle for the patties. The cleated belt bearing patties is passed through an opening of limited size defined by a rotating wheel, such that not more than one patty is contained between successive cleats on the belt. From the cleated conveyor, the patties are coupled to a pair of continuously rotating belts which face one another. The top belt of the pair is pivotally mounted such that it moves upwardly upon the insertion of the patties on the belt. An optical control circuit utilizing photoelectric means is energized by the pivotal motion of the upper belt mechanism and controls a feed mechanism which cuts wrapping paper of predetermined length and inserts it directly in the path of the oncoming patty. Consequently, as the patty is forced from between the facing belts at a considerable rate, the wrapping paper inserted in its path adheres to the front thickness and to the top and bottom surfaces of the patties. The wrapped patties are then coupled to a second belt arrangement identical to the first, and the second upper belt is likewise pivoted upwardly in response to a receipt of a patty. A second optical control circuit notes the pivotal movement of the second upper belt, and energizes a counter and output mechanism which constitutes a movable piston within a cylindrical receptacle and a plunger located thereabove to force the piston downward upon the receipt of each wrapped patty. When the counter mechanism reaches a predetermined count, an empty cylinder and piston is adjusted at the output of the second belt assembly, and the process continues.

Features of the present invention include rapid and efficient operation, accuracy of control, ease of dismanteling for cleaning purposes, and many other features which shall become apparent upon consideration of the following detailed description, and the claims which are appended hereto.

DESCRIPTION OF THE DRAWINGS

FIG. 6 shows a cross-sectional view of the paper supply and patty wrapping apparatus which embodies the principles of the present invention;

FIG. 7 shows a typical sequence of alternately wrapped patties;

FIG. 8 shows a cross sectional view of the apparatus of FIG. 6;

FIG. 9 shows a sectional version of a part of the apparatus of FIG. 8;

DETAILED DESCRIPTION

Figure 1:
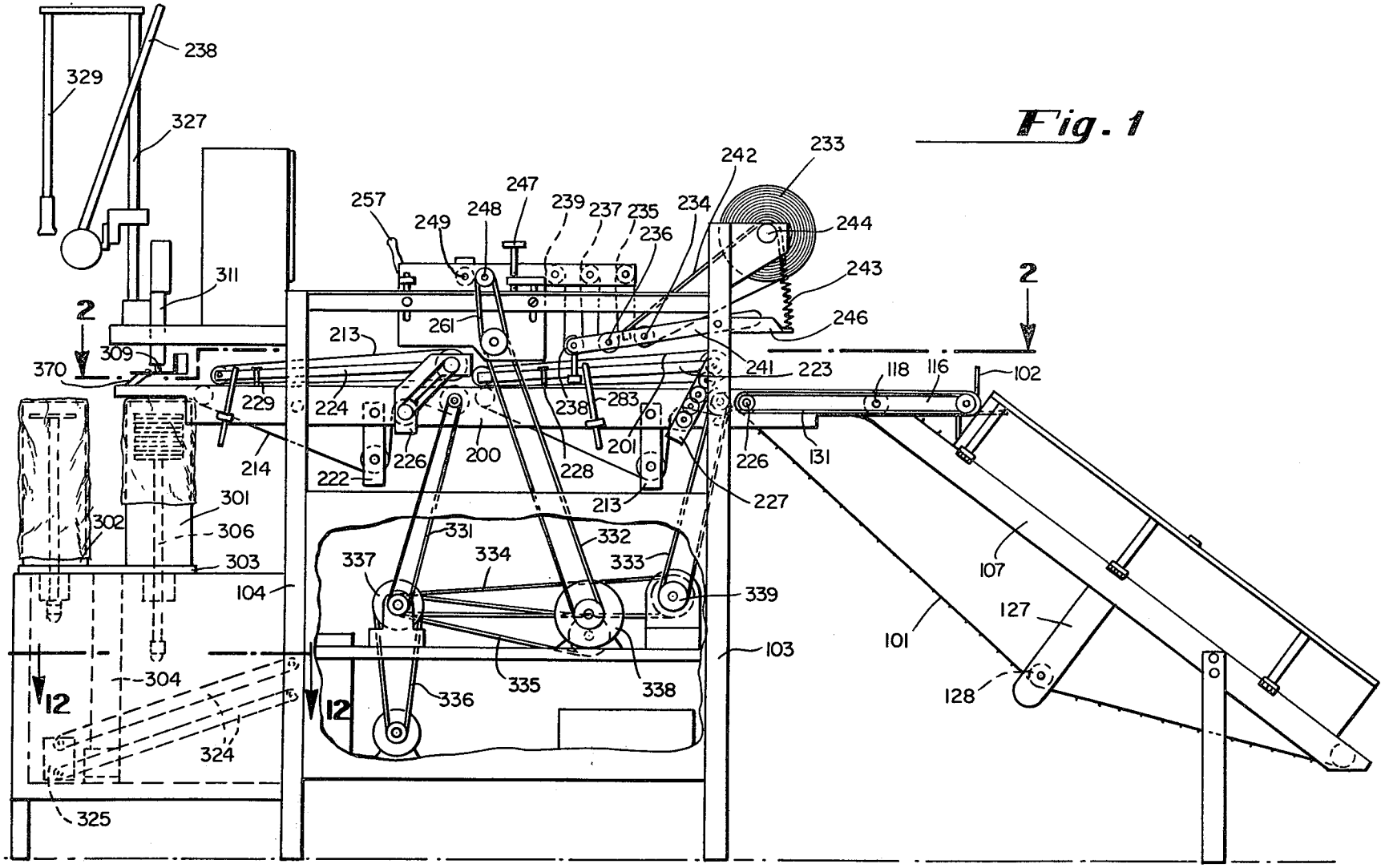
FIG. 1 shows a lateral view of a machine which embodies principles of the present invention.

FIG. 1 shows a lateral view of apparatus which embodies principles of the present invention. The mechanisms of FIG. 1 may be generally divided into three functional sections. At the right of the FIG. 1 apparatus, materials to be wrapped such as the hamburger patties are supplied to a take up mechanism including a cleated conveyor belt 101. Also, operating in synchronous harmony with the cleated belt 101 is a paddle wheel 102, which shall be designated herein as a "doffer". The cleated belt 101 and the "doffer" wheel 102 together comprise the first, or input function, of the apparatus of FIG. 1 by supplying patties to be wrapped and packed one at a time at predetermined intervals.

The second functional aspect of the FIG. 1 apparatus comprises all of the machinery located in FIG. 1 between the structural support brackets 103 and 104. This second aspect of the FIG. 1 apparatus performs the functions of propelling the patties as they are delivered from the cleated belt 101 toward the output apparatus, of inserting paper to be utilized for wrapping into the path of the moving patties, cutting that paper at appropriate lengths, applying it to the patties, and delivering the wrapped patties to an output. An important feature of this second aspect of the FIG. 1 apparatus is a control system including an optical circuit which is broken each time a patty is propelled therethrough. The supply of paper to the wrapping mechanism is regulated by this control circuit, as is the cutting thereof.

The third basic functional unit of the apparatus of FIG. 1 consists of output processing and wrapping mechanisms which stack the wrapped patties into groups of a predetermined number, enclosing them in a packaging material. This aspect is embodied by the machinery in the region of the left structural bracket 104 of FIG. 1. An important feature of this latter apparatus is a second optical control circuit which counts the patties as they are wrapped and propelled from the wrapping segment, all subsequent stacking and packaging occurring in response to this controlled count. Also, whenever the predetermined count is reached, the output control mechanism interrupts the operation of the entire machinery such that an operator may remove the now filled package of wrapped patties.

In the subsequent detailed description reference shall be made generally to more than one of the drawings of individual detailed features. For clarity, therefore, the same reference numerals shall be retained for a given piece in all of FIGS. 1 through 13. In this fashion, it is believed that confusion between similar parts may be kept to a minimum.

Referring first to FIG. 1, frozen patties are deposited in bulk in a trough 106 in random fashion. The trough 106 is mounted on an inclined table 107, through which passes the cleated belt 101. Hence, passage of the belt 101 upwardly along the incline 107 exposes the cleated portion of the belts to the patties which are in the repository of trough 106. As the belt 101 emerges from the top of the trough 106, the patties are situated between the individual cleats of the belt. This situation is more clearly evident from consideration of FIG. 3, 4 and 5, which show various cross-sectional and top views of the take-up mechanisms including the cleated belt 101. At the top of the inclined table 107, the belt is drawn over a rotating roller 108, where the motion of the belt 101 with the patties thereon is translated from an upward to a horizontal direction. In order conveniently to achieve this function in preparation for the wrapping process, the input apparatus includes the doffer wheel 102. It is clear that only one patty at a time should be fed to the wrapper. The rotation of the doffer wheel 102 in synchronous harmony with the motion of the cleated belt 101 causes the arms of the doffer 109 through 112 to rotate as the belt passes by.

Figure 5:
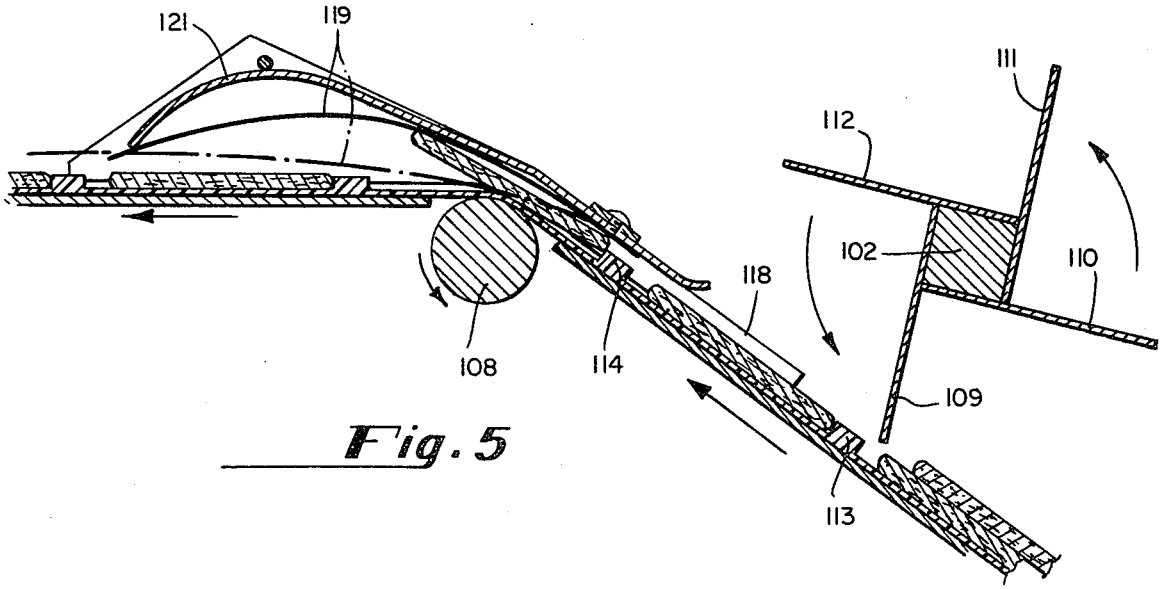
FIG. 5 shows a detailed cross-section of apparatus which takes up the patties from a supply.

In a preferred embodiment, the cleats 113-114 etc. of the cleated belt 101 are approximately of the thickness of the patties to be processed. The doffer wheel 102 is situated relative to the incline 107 by means of an extension 116 such that its rotating arms 109 through 112 pass in close proximity to the cleats 113, 114, etc. Moreover, the doffer wheel 102 is driven by means of the same mechanism as is the cleated belt 101, such that the turns of the arms of the doffer wheel 102 make contact with any objects on belt 101 that are thicker than a single patty. For example, as shown in FIG. 5, the two patties which were stuck together by freezing will be contacted by an arm of the doffer wheel 102, with the result that the bottom patty is maintained on the belt 101 by means of the next cleat, whereas the top patty is knocked free and back into the trough 106. In this fashion, only a single patty at a time is delivered from the cleated belt for wrapping and packaging.

Figure 2:
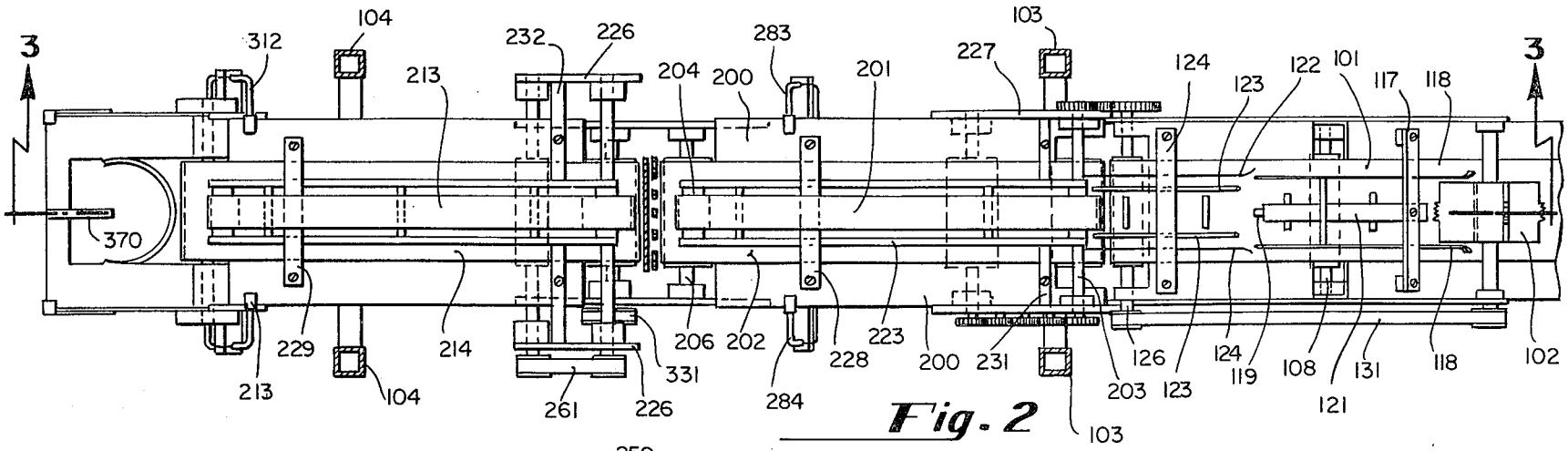
FIG. 2 shows a top view of the apparatus of FIG. 1.

It is also useful in the delivery of the patties for wrapping to knock free any ice or other material which may have accumulated thereon in the freezing process. Accordingly, as shown in FIG. 2, arms 109 through 112 of doffer 102 are provided with serrated edges. Hence, as the patties pass by the doffer wheel portion 102 adhering frozen patties along with any foreign material is scraped from the top of the patty.

Since the motion of the cleated belt 101 may be rather rapid, and since the patties as maintained on the cleated belt 101 are in rather close proximity to one another, provision is made at the rotating roller 108 to prevent dislocation of the patties from the cleats 113, 114, etc. as the direction of the belt 101 is translated from inclined to horizontal. In order to fulfill this function, a leaf spring is utilized, including a spring member 119 held in position by a middle bracket 121. The spring member 119 and its structural support 120, as well as a set of lateral guides 118, are positioned by a bracket 117 affixed to the inclined table 107. Thus, as the ridged frozen patties are guided toward the rotating roller 108 by the lateral guides 118, they come under the influence of the leaf spring 119 which prevents them from being dislocated from the belt 101. As the patties roll pass the pivotal roller 108, they are snapped back onto the belt 101 between the same cleats which formerly held them in place.

In order to insure that the patties as delivered by the cleated belt 101 will be exactly in the proper position for the wrapping mechanism, a second set of lateral guides 122 and a pair of vertical wire guides are provided. Both sets of secondary guides are maintained in position by a structural member 124. At this point, the functions required of the input mechanism including the cleated belt are realized, and the frozen patties are coupled to the second stage for wrapping, and subsequently to the output packaging stage. The cleated belt 101 passes over a rotating roller guide 126 and is directed back to the bottom of the inclined table 107, by a guide arm 127 attached to the inclined table 107, which also has a roller guide 128.

Figure 3:
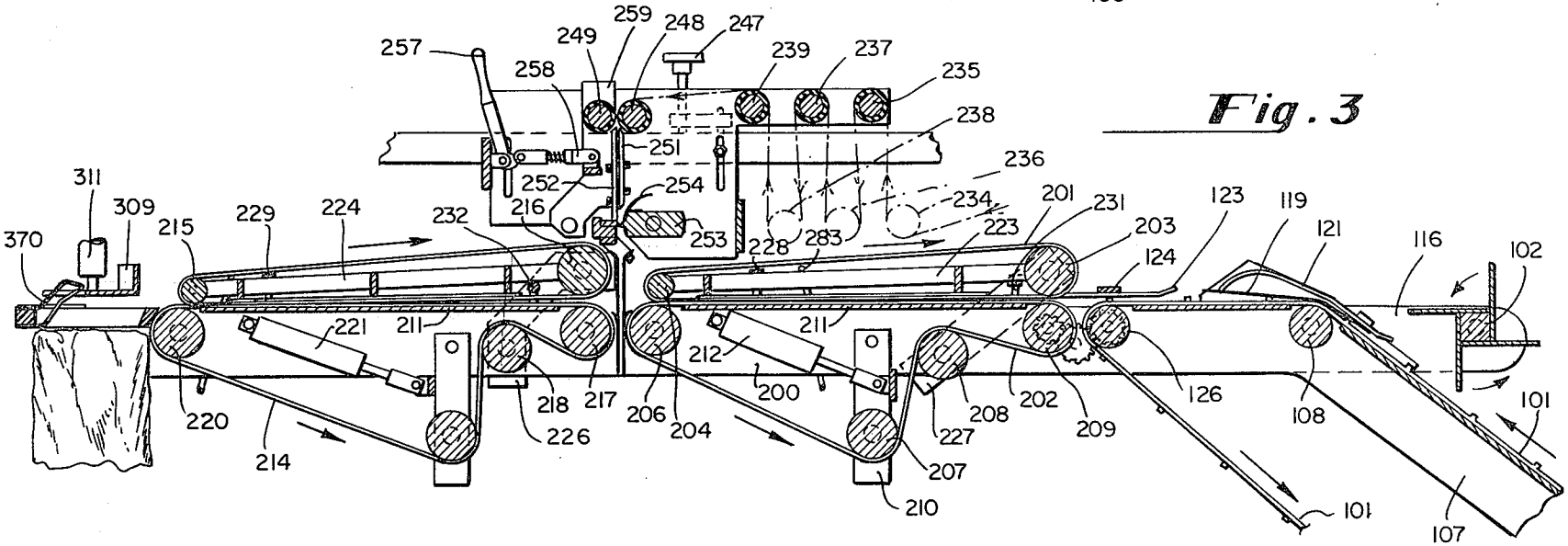
FIG. 3 shows a cutaway side view of the apparatus of FIG. 2.
Figure 4:
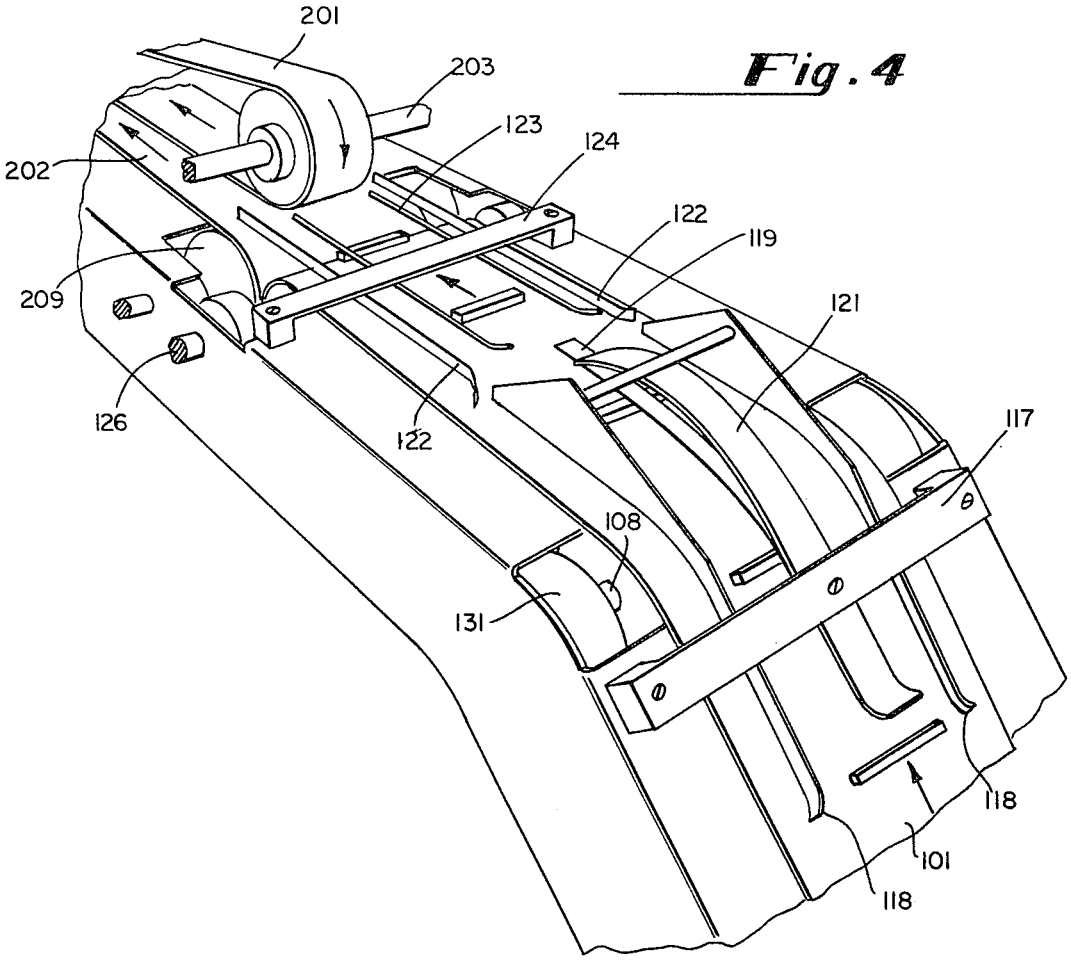
FIG. 4 shows a close up view of the input section of the FIG. 1 apparatus, where patties are coupled from an input conveyor to the wrapping machinery.

As is shown in FIGS. 1, 2 and 3, the cleated belt 101 and the doffer wheel 102 are operated by a belt 131 which is driven by a gear mechanism 129, which in turn is driven by the power machinery described hereinafter.

In summary, the input stage of the embodiment described includes a cleated belt 101 which takes frozen patties from an input trough 106 and passes them to processing mechanisms for wrapping. A doffer wheel 102 assures that only one patty will be processed at a time, and a spring mechanism 119 maintains the frozen patties as desired on the belt 101. These functions are demonstrated most clearly in the views shown in FIGS. 3, 4 and 5.

The next functional stage involves the actual wrapping of the frozen patties. Consequently, this stage involves the production and cutting to size of paper for wrapping, the positioning of that paper in the path of the moving patties, and the propulsion of the patties into the paper such that the paper adheres thereto, whereupon the patties are coupled to the stage. In accordance with the principles of the present invention, a motive means including continuous loop drives is utilized to propel the frozen matties from the input conveyor 101 across to the output apparatus. In a preferred embodiment, the paper is of sufficient length to adhere to the top and bottom of the patties, thereby necessitating only the wrapping of alternate patties.

The motive means which translates the patties may best be appreciated by reference to FIG. 3, which is a cutaway view of the FIG. 1 apparatus. Shown there are two identical sets of belt drive assemblies.

More particularly, as the patties are coupled at the guide mechanism 123 from the cleated belt 101, they are passed to a pair of continuous loop drive belts which are approximately tangent to one another. The top belt 201 is continuous about a pair of rollers 203 and 204, while the lower belt 202 is driven by rollers 206, 207, 208 and 209. The respective directions of rotations of the belts 201 and 202 are indicated by arrows in FIG. 3. Both of the belts 201 and 202 move at the same rate as one another, and in a preferred embodiment, the rate of belts 201 and 202 is five to six times as fast as the rate of rotation of the cleated belt 101. Consequently, as the patties are delivered at the guide 123 from the cleated belt 101 to the motive belts 201 and 202 at rollers 203 and 209, the frozen patties are accelerated considerably and are passed between belts 201 and 202 from right to left in FIG. 3 along the lateral support structure 200. An air cylinder maintains the rotatable arm 213 and roller 207 in position. The purpose of the air cylinder is to automatically remove tension from the belt, thereby loosening it for washdown when air is shut off. Turning on air automatically tensions the belt.

A second pair of belts 213 and 214, structurally identical to the first belts 201 and 202, is situated further to the left in FIG. 3. The second pair of belts 213 and 214 also operates identically to the first pair 201 and 202. Hence, the top belt 213 is driven by rollers 215 and 216, while the bottom belt 214 is driven by rollers 217, 218, 219 and 220. The rollers 217 through 220 are situated relative to the lateral support structure 200 identically to rollers 206 through 209 which drive the lower belt 202 of the first belt drive assembly. Similarly, an air cylinder 221 maintains an arm 222 in a position such that the roller guide 219 for the lower belt 214, thereby keeping the belt in proper tension. Therefore, as the patties are passed between belts 201 and 202 past rollers 204 and 206, they are coupled to wrapping paper and subsequently are moved to belts 213 and 214 at pick-up rollers 216 and 217. Thereupon, the wrapped frozen patties are passed between belts 213 and 214 toward output rollers 215 and 220.

While the top belts 201 and 213 are maintained in the shape shown by connection of their respective end rollers by structural members 223 and 224 (i.e., which constitute horizontal bars and lateral members), they are not fixed relative to the other apparatus of the figure. Instead, each of the respective upper belt mechanisms is pivotally attached to the main lateral support structure 200. As a patty comes between associated upper and lower belts, the upper belt pivots upwardly by the thickness of the patty.

In order to facilitate further explanation, the combination of support bar 223, rollers 203 and 204, and belt 201 shall be designated the "first upper belt assembly", the combination of belt 202 with its associated rollers 206 through 209 shall be designated the "first lower belt assembly", the combination of belt 213 with its associated rollers 215 and 216 and support arm 224 as the "second upper roller assembly", and the combination of belt 214 with its associated rollers 217 through 220 as the "second lower belt assembly". As shall become apparent, the pivoting capability ascribed to the first and second belt assemblies not only permits for efficient processing of the frozen patties as they are passed through the motive mechanism including all four belt assemblies but it also provides means for controlling both the paper feeding and the cutting operations, as well as the output packaging apparatus.

The first upper belt assembly is pivotally attached to the lateral support structure 200 by means of a pivot bar 227. In addition, the main support arm 223 of the first upper belt assembly is held in position at either end by a pair of supports 228 and 231. The pivot arm 227 maintains the first upper belt assembly in some degree of tension, so that only the force of a patty passing between belts 201 and 202 will force the upper belt assembly upward; otherwise, the first upper belt assembly rests near the first lower belt assembly. A lower limit on the movement of the first upper belt assembly is established by means of support structures 228 and 231. As may be seen from FIG. 2, the support structures 228 and 231 span the first upper belt assembly to limit its travel.

The second upper belt assembly is similarly pivotable. A bent pivot arm 226 provides the same function to the input end of the second upper belt assembly as did the straight pivot arm 227 for the first upper belt assembly. Likewise, a pair of support braces 229 and 232 limits the downward travel of the pivotable second upper belt assembly.

In summary, frozen patties which are delivered from the cleated belt 101 are coupled between moving belt assemblies including first and second belts 201 and 202. As the patties are conveyed between the first upper and lower belt assemmblies (at approximately five times the rate of the cleated belt 101) the first upper belt assembly pivots upwardly to permit the patty to pass between the belts 201 and 202. After the wrapping procedure, which is discussed hereinafter, the patties are coupled to a similar set of belts including the second upper and lower belt assemblies. The second upper belt assembly, like the first, pivots upwardly to permit passage of the frozen patties therethrough.

The next function to be described is provision for paper of desirable length which is to be applied to the frozen patties. Since the embodiments described are particularly designed to apply separator papers between patties, the first and second belt assemblies are used to provide an interstice in the path of moving patties such that when a paper of desired length is placed in the interstitial area, the moving patty "picks up" the paper, which adheres to and is folded around on both sides of the patty, and the patty carries the paper with it through the second belt assemblies. For example, FIG. 7 shows a series of patties in which alternate ones have been so processed, and have separator papers (indicated by the darker lines) surrounding on both sides. Thus, in order to fulfill these purposes, apparatus is needed which furnishes pieces of wrapping paper at the desired time in the desired length to be caught up by the patties as they are passed from the first belt assemblies to the second belt assemblies. The means and manner in which this function is provided may be appreciated from consideration of FIGS. 1, 2, 3 and 6.

It may be noted that full wrapping, rather than mere application of separator wrappers, may be practiced merely by supplying paper segments of larger dimension, and providing for sealing the three open sides of the wrapper after it is thereby applied to the patties.

In FIG. 1, a continuous roll of paper (waxed paper is preferable for separator sheets) is fed over a series of pulleys 234 through 239. The paper roll 233 is itself affixed to the main support frame 103, as are the odd numbered pulleys 235, 237 and 239, but the even number pulleys 234, 236, 238 are mounted on a rotatable bracket arm 241. In turn, the arm 241 is coupled by means of a leather strap 242 and a spring 243 over the hub of the paper roll 233 to a fixed extension 246 of the main support frame 103. In addition, the last pulley 238 on the pivot arm 241 is connected downwardly to the support arms 233 of the first upper belt assembly. An arrangement therefore results in which the paper from the roll 233 and around the pulleys 234 through 239 is maintained in constant tension by means of the counteracting forces of the extensible spring 243 and of the force downward on the rotating arm 241 from the first upper belt assembly. It is apparent that uneven feed of paper from the roll 233 would result in very uneven wrappers for the patties. The arrangement of the rotating arm 241 as shown in FIG. 1 prevents the paper from going slack. A tension adjustment 247 also allows for further vernier control.

Referring to FIGS. 3 and 6, the paper from the final tension pulley 239 is passed between a pair of paper drive rollers 248 and 249. The rollers 248 and 249 are driven as shown in FIG. 1, by a pair of belts 261 and 262 from a power source by way of an intermittent drive unit 338. The paper is driven by the rollers 248 and 249 between a pair interfacing grids 264 and 269 and down to the location of the cutting. In particular, a first fixed knife blade 256 is attached to the main support structure, and a second knife blade 255 is inserted in a rotating cam 253 which is operated as described hereinafter. As the paper passes between the guide plates 251 and 252, it is severed each time the rotating cam 253 causes the second knife blade 255 to make contact with the first knife 256. For purposes of servicing the machinery, the rotating knife blade 255 is maintained in position in the rotating cam 253 by means of a set screw adjustment 263. Also, for purposes of servicing, a lever arm 257 pivotally controls the position of the main structural block 259 upon which the second drive roller 249 is mounted. Consequently, when it is desired to place a new roll of paper in the machine, the lever 257 allows for the structural member 259 to be pivotted backward as shown by dotted lines in FIG. 6, whereupon the second roller 249 and the associated guide plate 252 also are moved backward creating space for the paper to be threaded therethrough. Then, the lever 257 may be closed once more and the structure including roller 249 and guide plate 252 is returned to operating position as shown in FIG. 3 and in solid lines in FIG. 6.

The positioning of the paper after it has been cut by blades 255 and 256 may be appreciated by consideration of FIGS. 6, 8 and 9. Referring particularly to FIG. 6, the paper passes from the blades 255 and 256 between plates 267, 268 and 269, which are supported by guides 264 and 265. Thus, the paper is positioned into a slot between, formed by the plates 267, 268, 269, and the grid sidewalls 264 and 265. In order first to insure that the paper will be slotted properly and secondly to permit the paper to be pulled outwardly as the patties pass through from the first set of belt assemblies to a second set of belt assemblies, the grid 264 and the plates 267, 268 and 269 are curved as shown.

A view of the apparatus of FIG. 6 which is useful for understanding of both the drive and the guiding of the paper is shown in FIG. 8, which is a sectional view, as shown, of the FIG. 6 machinery. First, it may be seen from FIG. 8 how the main drive belt 262 is utilized in conjunction with a second belt 261 to drive the roller 248 and the cam 253 together. That is, the main motor drive of the apparatus of FIG. 1 by means of belt 262 applies power to shaft 265. This energy is in turn transferred by means of pulleys 278 and 261 to the drive roller 248 (on shaft 274) of FIGS. 8 and 6. A noteworthy feature of the apparatus shown is that also driven by axles 274 and 275 are a separate set of belt drive pulleys 272 and 273. It may be appreciated that, depending upon the size and thickness of the patties being wrapped, a different length of wrapping paper may be called for. The apparatus shown provides facility to adapt for different lengths of paper by changing the drive belt 261 from the pulleys shown (170 and 278), to the alternate pulleys 272 and 273. Since the size of those pulleys may be freely varied, the rate at which the drive roller 248 is turned depends upon the size of apparatus upon which belt 261 is affixed. Consequently, facility for variation in the length of the paper fed to the patties results.

The basic function of the apparatus shown cross-sectionally in FIG. 8 is to guide the cut papers down and into the path of the patties which are being moved by the belt assemblies. The vertical guide bars 251, which are shown in profile in FIG. 6 and which are shown severally in FIG. 8, are maintained in position by series of cross members 275, 278 and 279. Hence, the paper is guided effectively to a position where in the path of passing patties, thence to be cut by the rotating knife 255. The position for a patty 316 to pass through is shown in broken lines in FIGS. 6 and 8.

In addition to the mechanical guidance afforded by apparatus 264 through 268, additional provision is made due to the curl of the paper which may result from its storage on roll 233. This control is afforded by means of a compressed air feed 266, which is attached as shown adjacent to the metallic guide plate 269. The compressed air feed 266 is based on the proposition that, as the curled papers are passed downward from the blades between guides 264 and 265, any tendency for it to curl outward at the termination of the vertical bars 264 and 265 may be curled by the flow of air escaping from holes in the compressed air feed 266. The compressed air release is spacially adjusted such that as the curled paper passes the force of the escaping air, it is taken up by the mechanical guidance of guide plates 267 and 268, and falls to the bottom of the slot therebetween. Consequently, as the patties pass from the first belt assemblies through the structure of FIG. 8 and to the second belt assemblies, the paper for wrapping spans the opening between the solid guide plates 267 and 269. As they pass through with considerable force, the paper adheres to the front edge of the patty, and along the top and bottom as well. This operation may be seen in the portion of FIG. 9. In FIG. 9, the paper is shown by a broken line 281, and the patty 316 is shown in similar fashion.

In summary, FIGS. 6, 8, and 9 together demonstrate how the paper is driven to a pair of blades which cut the paper to appropriate lengths, and the cut paper pieces are guided both mechanically and by means of the release of compressed air to a point which effectively blocks the path of oncoming patties. The patties are propelled through the guide mechanism with sufficient force that the paper adheres to and is drawn along with the patty to the second roller belt assemblies. The result is coverage such as shown in FIGS. 6 and 7.

In a preferred embodiment, since the paper folds over on both sides of the patties, it is not necessary that each patty processed should be so wrapped. Rather, since they are to be stacked one on top of another for effective separation, it is only necessary to apply wrapping paper to alternate patties as they pass through the machinery (i.e., such as shown symbolically in FIG. 7).

The means of control by which the paper is cut and applied is as follows. Situated with adjustable precision on either side of the first upper belt assembly is a photo-electric cell system comprising two photo-electric units 283, and 284. As is evident from FIG. 3, the photo-electric transmitter and receiver (one on either side of the belt 201) are located just above the support arms 223 of the first upper belt assembly whenever the belt assembly is in its lowest position. Consequently, whenever there are not patties between the first upper and lower belt assemblies, and the first upper belt assembly is not pivoted upwardly at all, an unbroken optical circuit exists between the photo-electric mechanisms 283, and 284. Whenever any of the patties is coupled from the cleated belt 101 to the space between the first upper and lower belt mechanisms, and the first upper belt mechanisms is pivoted upwardly as a result thereof, the support arms 223 of the first upper belt assembly moves into the line between the photo-electric mechanisms 283 and 284. The alternate completion and breakage of the optical circuit between photo-electric elements 283 and 284 is utilized to control the feed of paper and the action of the rotating blade 253.

This is achieved as follows. Both the drive of the cam 253 with the blade 255 attached therein and of the drive roller 248 are maintained under the control of the optical circuit between optical elements 283 and 284. For each patty passing through the first upper and lower belts assemblies which are to be wrapped with paper, the breakage of the optical circuit causes the cam 253 to go through one complete turn, and similarly for the feed roller to be energized to supply a correct length of paper. For alternate patties, for which no wrapping is desired, the cam 253 and the feed roller 248 remain stationary. The air flow from tube 266 is similarly regulated. This alternate fashion of control is achieved by means of an intermittent drive mechanism, many of which are well-known in the art. Of course, in an alternative embodiment for which a wrapping is desired for every patty which passes through, each breakage of the optical circuit between photo-sensitive elements 283 and 284 energizes the feed roller 248, the cutting blade on cam 253 and the air duct 266. Likewise, any other combination of energizing signals for the feed roller 248, the cam 253, and the duct 266 may be derived.

In summary, the pivoting of the first upper belt assembly by means of patties passing between belts 201 and 202 alternately energizes and breaks an optical circuit maintained between photoelectric elements 283 and 284. This in turn causes a predetermined amount of paper to be fed and cut. The paper thereby produced is inserted into the path of ongoing patties, and in a preferred embodiment alternate ones of the patties are coated on either side with a piece of paper. Thereupon, all patties are passed onto the second upper and lower belt assemblies to be processed for final packaging.

It was pointed out hereinbefore that adjustment of the size of the pulleys driving the feed roller 248 would result in paper of different size for any correspondingly dimensioned patties. It is of course evident that such changes would also have to be accompanied by similar changes in the mechanical guide mechanisms of FIGS. 8 and 9. Such alterations, however, would merely be ones of dimension in order to permit the larger (or smaller) paper to be situated properly about the path of the oncoming patties. Consequently, all such adjustments would be well within the ability of those skilled in the art.

Referring back to FIG. 1, the third basic function to be performed is the take up of wrapped patties, and the packaging thereof. In the embodiments described, the basic packaging procedure features the insertion of the respective patties in a stacked fashion within a cylindrical receptacle. Preferentially, this receptacle may be lined by the machine operator, or automatically, with packaging material, which in turn may be readily and efficiently sealed upon determined count. Hence, as is shown clearly in FIG. 2 and 3, the second upper and lower belt assemblies terminate at a point suitable for location of packaging apparatus. More particularly, as shown in FIG. 1, a pair of cylindrical receptacles 301 and 302 are affixed to a table 303, which in turn is mounted on a rotating support 304. Within each receptacle is a piston, 306 and 307, which is conditioned to have patties piled thereon. In particular, the position of the top platform of the pistons 306 and 307 is dependent upon the number of patties which have been piled thereon.

Figure 10:
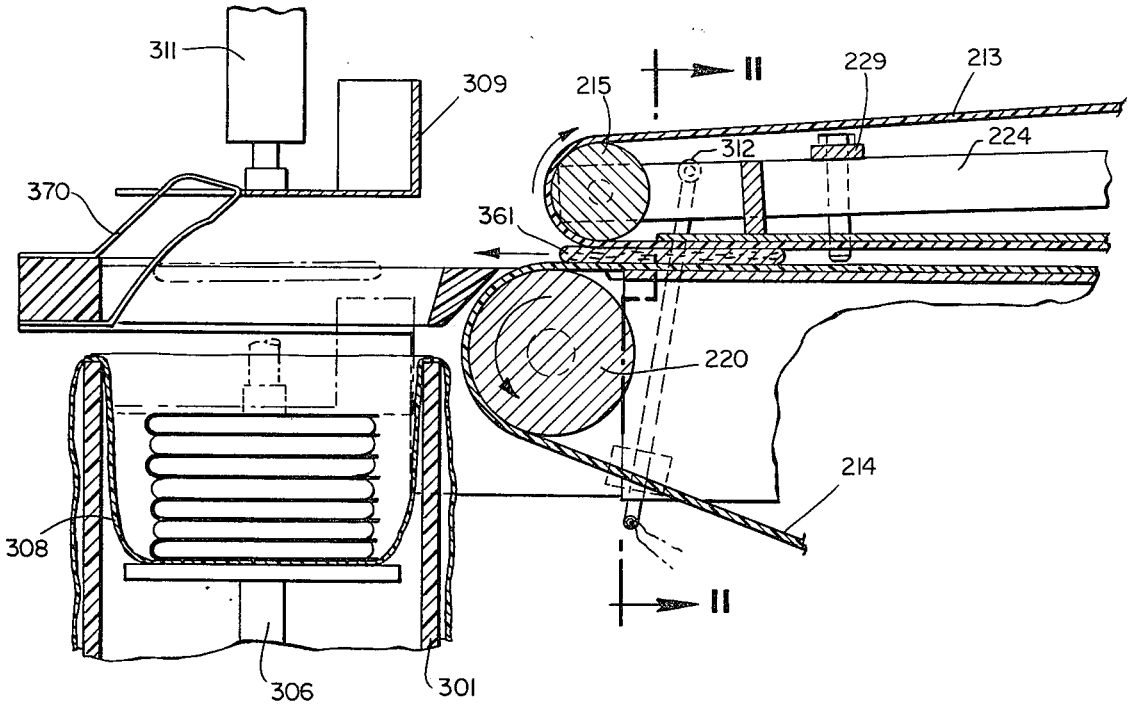
FIG. 10 shows a take up and stacking means which operates in accordance with the principles of the present invention.

With particular reference to FIG. 10, which shows a detailed cross-section of the termination of the second upper and lower belt assemblies, patties are propelled outwardly and strike a retaining guide member 370. In addition, a top piston 309 prevents upward movement. Thus, the patties are reflected from the retaining member 307 downwardly into the awaiting receptacle, such as 301. As shown in FIG. 10, a packaging bag (such as, for example, polyethylene) has been inserted over the piston 306 of receptacle 301, such that as the patties are stacked on the piston, they simultaneously enclose themselves in the packaging bag.

Like the photoelectric control system which monitors operation of the paper feed by means the cam 253 and feed roller 248, the second upper and lower belt assemblies include a photoelectric control system. This latter system, however, controls the packaging of the wrapped patties in the output receptacles 301 and 302.

More particularly, the photoelectric control for the output packaging includes a pair of photoelectric elements, 312 and 313, one being a transmitter and the other being a reflection element or receiver (depending on the nature of the apparatus used). By means of the spacer element 229, the pivot position of the second upper belt assembly is correspondingly limited. However, when no patties are passed between belts 213 and 214, the lateral support arms 224 of the second upper belt assembly are located below the transverse line between photoelectric elements 312 and 313. In such circumstances, the optical circuit defined thereby is unbroken. On the other hand, when a patty such as 316 is lodged between the belts 213 and 214, the second upper belt assembly pivots upwardly as shown.

During such circumstances, the optical circuit is broken and the control function monitored by the photoelectric element is accomplished. (It is interesting to note that the foregoing control process involving photoelectric elements 283 and 284 is identical in structure, but merely accomplishes a different control function).

Figure 11:
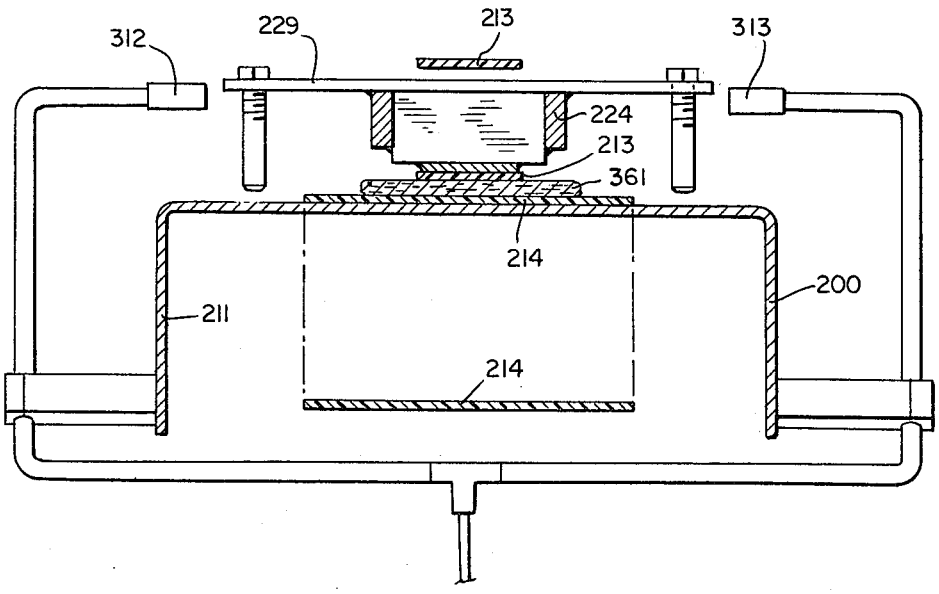
FIG. 11 shows a cross-sectional view of control means which regulates the operation of the FIG. 10 apparatus.

The particular control function performed by photoelectric elements 312 and 313 in FIG. 10 and 11 is the actuation of a counter (not shown) and of a plunger 309 which, upon receipt of each individual patty, forces the piston 309 downward, thereby driving piston 306 of the receptacle 301 downward by similar amount. In a preferred embodiment, the downward travel of the piston 309, and the consequent movement of piston 306, is exactly equal to the thickness of one of the patties being packaged. Consequently, if the patties are ½ inch thick, the passage of each patty between the upper and lower belt assemblies causes the optical circuit between the elements 312 and 313 to be broken, and consequently causes the piston 309 to be driven down to push the pile of patties and piston 306 of receptacle 301, down by ½ inch. This stacking and packaging function occurs until enough patties have been inserted into container 308 of the receptacle 301 to fill it. At such time, the counter actuates a rotation of the table 303 such that the now filled receptacle 301 is turned away from the feed mechanism, and the empty receptacle 302 is positioned in its place.

Figure 12:
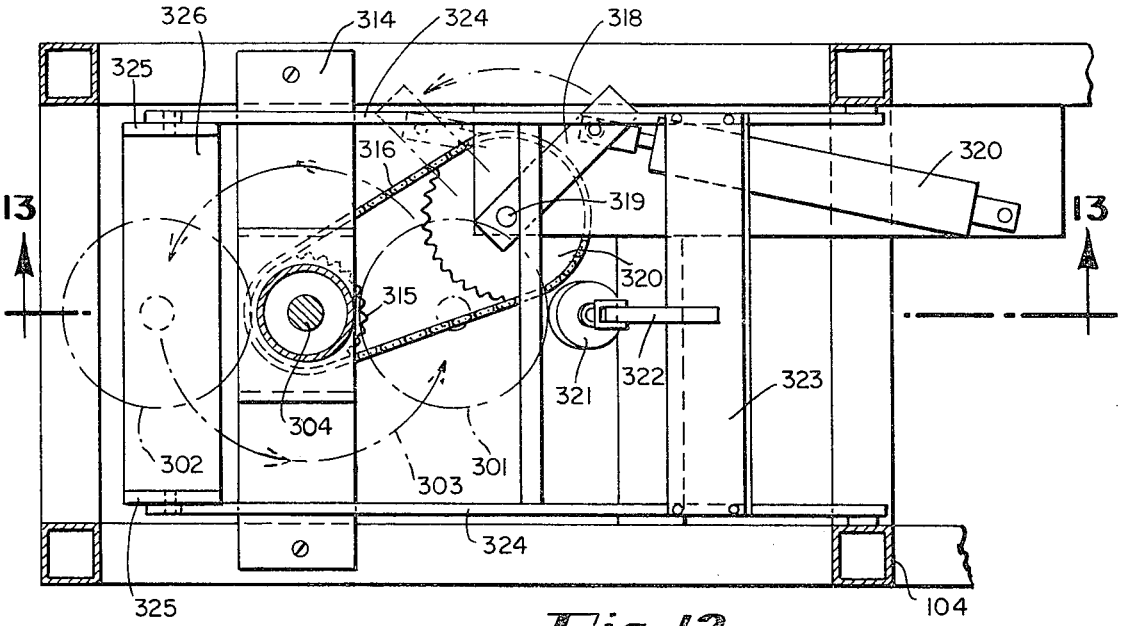
FIGS. 12 and 13 show views of the mechanisms which drive the take up apparatus of FIG. 11.
Figure 13:
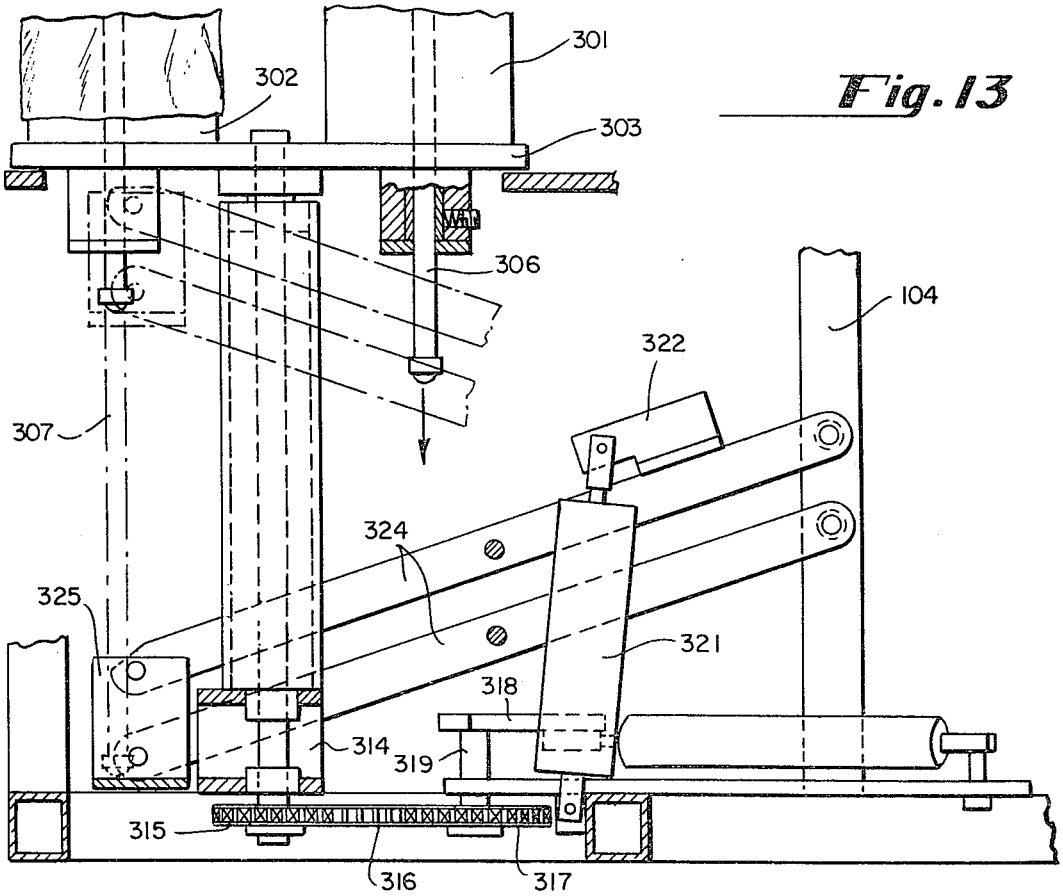

The operation of the table 303 upon which receptacles 301 and 302 are mounted may be understood from consideration of FIGS. 12 and 13 in conjunction with FIG. 1. In FIGS. 12 and 13, the receptacle table 303 is connected by a means of a downward shaft 304 into a drive gear 315. The drive gear is in turn connected and driven by a drive chain 316 from a principal gear 317. The principal gear 317 is connected by means of a fixed joint 319 to a moment arm 318 to the plunger of an air cylinder 320. As is shown in FIG. 12, each time the air cylinder 320 is energized, its plunger is extended outwardly and the moment arm 318 turns by approximately a quarter turn. This causes the principal gear 317 to turn similarly, thereby actuating the drive gear 315 to turn the table 303 for the receptacles 301 and 302 by a half turn. Consequently, as is shown in broken lines in FIG. 12, the table 303 rotates by ½ turn and the receptacles 301 and 302 change position with one another. The connection of the drive assembly 315, 316 and 317 with the table 303 and its vertical member 304 is by means of a fixed cross member 314. Clearly, therefore, the control and count actuated by the photoelectric units 312 and 313 may be readily utilized to control the position of the table 303 merely by actuation of the air cylinder 320. In a preferred operating mode, a change in position of the receptacles 301 and 302 occurs once every forty patties. Thereupon, the cylinder 320 is energized, its plunger causes moment arm 318 to rotate as shown, and by means of the gears 315 and 317 connected by drive chain 316, the table 303 rotates by ½ turn.

Yet another packaging function is embodied in the apparatus shown in the two views of 12 and 13. Once the receptacle 301 or 302 is filled and the reversal of position as described hereinbefore is accomplished, the packaging bag such as 302 may be sealed by means of a heat seal or stapling arrangement. Thereupon, the operator must remove the full package and replace it with an empty bag for subsequent reversal receptacles 301 and 302. In order to facilitate this exchange operation, the apparatus of FIGS. 12 and 13 provides means for upwardly reinstating the position of the plunger 307 as shown in FIG. 1. In other words, after the receptacles 301 and 302 have been reversed in position, a power operation embodied in an air cylinder 321 and its connection with a lower drive platform 325 and 326 pushes the plunger back upwardly as shown in FIG. 13. In order to accomplish this, a set of lateral members 324 are attached to the main frame 104 at one end, and have a platform 325 and 326 attached at the other end. Whenever a receptacle is filled with wrapped patties, the plunger 306 or 307 has been driven down into the broken lined position of plunger 307 in FIG. 13. Thereupon, air cylinder 321 is actuated, its plunger, which is connected by means of members 322 and 323 to the lateral members 324, pushes the platform 325 and 326 upward, and forces the plunger 306 or 307 upward along with it.

The apparatus shown in FIG. 1 also includes members situated above the receptacle 301 or 302 which are utilized for sealing the filled packages. As is shown symbolically in FIG. 1, a a vertical member 327 has pivotally attached thereto a lever arm 328. Controlled by these two members is a sealing member 329. Whenever the lever 328 is operated, the sealing member 329 is forced downward toward the position of the receptacle 302 in FIG. 1. Thereupon, it may be used accordingly by the machine operator.

In a preferred embodiment, operation of the optical control 312 and 213 in conjunction with the positioning of the receptacles 301 and 302 occurs on an intermittent basis. That is, the counting function performed in accordance with the optical control of elements 312 and 313 also is utilized to stop the operation of the entire machine each time the table 303 is rotated by 180° and the filled bag is repositioned upwardly. In particular, this stoppage of motion occurs by means of a braking system shown from the cutaway of FIG. 1. Under the control of the counting mechanism of the photoelectric control apparatus 312 and 313, a series of clutch-brakes 337, 338, and 339 are connected by means of respective belts to various drive points in the machinery. In particular, belts 331, 332 and 333 are the ones which convey power to the cleated belt 101, to the first upper and lower belt assemblies, to the second upper lower belt assemblies, and to the paper drive including roller 248 and the cutting blade 255.

Hence, stoppage of the three main drive belts 331, 332 and 333 effectively will interrupt the operation of the machine, from beginning to end. In a preferred embodiment, the the clutches are caused to be disengaged for one half second each time a predetermined count of wrapped patties has been achieved, the table 303 has been rotated 180°, and the filled piston has been repositioned. This temporary stoppage of the machine allows time for the operator to utilize the sealing mechanism 327, 328 and 329, and to remove the sealed package. Thereupon, by means of a power button, now shown, the operator once more energizes operation of the entire machine, and the clutchbrake are caused once more to transmit power to the various paper feed and belt drive assemblies. Moreover, at this time the operator may replace the full bag of patties with an empty bag ready for refilling. Of course, this periodic stopping function is by no means essential to the principles of the present invention. Quite evidently, the machine may be operated on a continuous basis so long as the operator has facility to perform the tasks at a speed comparable to the packing speed of the machine. Likewise, manual override and interrupt facilities may be provided at any point in operation.

In summary, the alternately wrapped patties from the second upper and lower belt mechanisms are thrust outwardly into the receptacles 301 and 302. There, in conjunction with pistons 306 and 309, they are successively stacked within a packaging material, and at a predetermined time, the packing operation ceases, the table is rotated by 180 degrees, the piston is repositioned, and to allow for a fresh receptacle for packing, and the operator is given time to seal and remove the full package. Operation continues in cyclic fashion.

It should be evident that many variations of the apparatus shown herein may occur to those skilled in the art without departing from the spirit or the scope of the principles of the present invention. For example, virtually any sealing and packing apparatus at the terminal end of the machinery may be utilized in a place as that described. Similarly, the drive and motive mechanisms may be altered in order to adjust for different types and sizes of items to be wrapped. Finally, additional apparatus may be added either precedent or antecedent to conveyance by the second belt assemblies for sealing the individual patties within the wrappers applied as described herein.

What is claimed is:

1. Receptacle means for collecting wrapped items of predetermined thickness from a motive conveyor comprising:

a. first piston means situated to collect items from said motive means, one on top of another;

b. plunger means located above said piston means; and c. control means for operating said plunger automatically, tp drive said first piston means downward, when said item is positioned in proper relation to said receptacle means, by a predetermined distance, said plunger being adjustably regulated by said control means whereby said predetermined distance substantially equals said thickness of said items being received from said motive means.

2. Apparatus as described in Claim 1 and further including:

a. a rotatable table supporting said first piston means and further including at least one other piston means identical to said first piston means; and b. first drive means for rotating said table to position different piston means to collect items from said motive means at predetermined intervals in response to said control means.

3. Apparatus as described in claim 2 wherein each of said piston means includes a hollow columnar means adapted to support a container for said items, and a piston within said means beneath the container, said piston including a downwardly depending shaft penetrating the bottom of said columnar means.

4. Apparatus as described in claim 3 and further including second drive means below said receptacle means selectively to force said piston upwardly, thereby ejecting a container filled with said items from its associated columnar means.

5. Apparatus as described in claim 3 and further including lever actuated sealing means located above said receptacle means for selectively sealing a container filled with said items.

6. Apparatus as described in claim 3 wherein said shaft is held positioned relative to said columnar means by a friction joint, the friction of said joint being sufficient to support said items, but yielding to the force of said plunger means.

7. Apparatus as described in claim 1 and further including a means for interrupting the automatic operation of said apparatus; and a means for instantly energizing said apparatus whereby said automatic operation is resumed.

* * * * *